US007101221B1

(12) United States Patent
Chen

(10) Patent No.: US 7,101,221 B1
(45) Date of Patent: Sep. 5, 2006

(54) POWER TRANSMISSION CABLE

(75) Inventor: Yung-Fu Chen, Xindian (TW)

(73) Assignee: Topower Computer Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 11/107,930

(22) Filed: Apr. 18, 2005

(51) Int. Cl.
*H01R 11/00* (2006.01)

(52) U.S. Cl. ..... 439/502

(58) Field of Classification Search ..... 439/502, 439/650, 503, 505–506, 638–639
See application file for complete search history.

(56) References Cited

U.S. PATENT DOCUMENTS 5,044,971 A * 9/1991 Hollingsworth ..... 439/215
6,790,094 B1 * 9/2004 Bergmann et al. ..... 439/653
6,818,825 B1 * 11/2004 Tharman ..... 174/50.52
6,878,889 B1 * 4/2005 Horst et al. ..... 200/51.11
2004/0248462 A1 * 12/2004 Dyer et al. ..... 439/502

* cited by examiner

*Primary Examiner*—J. F. Duverne
(74) *Attorney, Agent, or Firm*—Birch, Stewart, Kolasch & Birch, LLP

(57) ABSTRACT

At least one set of power transmission cable is electrically coupled to a power supply and an electronic device powered by the power supply. The power transmission cable comprises: a connector comprising a first connect part, a second connect part, and a third connect part vertical to the first connect part and utilized to insertedly joint to the electronic device; and an electrically-conductive line, which is electrically coupled to the second connect part and has an electric plug, wherein the first connect part is electrically coupled to the power supply or separably and electrically coupled to the electric plug of the precedent electrically-conductive line to enable the user to determine the length and quantity of the power transmission cable to be connected according to the quantity of the electronic devices so that the problems resulting from the inseparable redundant cable in the conventional power transmission cable can be avoided.

17 Claims, 10 Drawing Sheets

POWER TRANSMISSION CABLE

FIELD OF THE INVENTION

The present invention relates to a power transmission cable, particularly to one that electrically interconnects a power supply and electronic devices powered by the power supply.

BACKGROUND OF THE INVENTION

The quality of a power supply is a key factor of determining stable operation and quality of a computer system. With the progress of science and technology, the quality demand for the power supply of the electronic device also grows higher and higher. The quality of overall power output will be decayed owing to the quality instability of inputting power source, which will induce the electronic device to stop operating and the computer system to stop working, and thus, important data or information will be lost.

In addition to power quality, the cable management of the power cable is also a big trouble. Referring to FIG. 1, the conventional power cable a is assembled to its terminal connector a1 (such as the electric plug of SATA or AT/ATX specification) horizontally, and when the terminal connector a1 is plugged to engage with an electronic device, the stretch will include the horizontal portion of the pendent power cable a in addition to the original length of the terminal connector a1. However, the interior space of a general computer is limited, and the conventional power cable a and its terminal connector a1 occupy too much space, which will influence the management of the redundant cable. Further, lacking effective management of the redundant cable results in that the heat-dissipating air flow cannot be effectively guided which incurs inferior heat dissipation and influences the efficacy of the computer. To improve the heat-dissipation and cable-management problems resulting from too small space between the electronic devices and the power supply, and to provide the user with hot-swap function, the manufacturer of computer chassis alternatively adopts the side connection for the installation of the electronic devices; however, the overall lengths of the conventional power cable a and its terminal connector a1 are too large, so that the manufacturer has to redesign the computer chassis, e.g. enlarging the width of the computer chassis, which will raise the cost, bring about troubles and does not provide the desired efficacy.

Referring to FIG. 2, in order to solve the aforementioned problem, some manufacturer assemble the power cable b and its terminal connector b1 in a mutually vertical way, like the piercing technique in telephone line, which can be free from the horizontal portion of the pendent power cable b. In such a design, multiple terminal connectors b1, which meets the number of the electronic devices possibly installed in the computer chassis, are apposed in the same power cable b. However, as the user does not always equip his computer chassis with the maximum number of electronic devices, all the existing terminal connectors b1 are not necessarily exhausted. Thus, there are always redundant power cables existing, e.g. in the FIG. 4 the terminal connector does not connect any electronic device, and the problem of cable management still persists. Further, the constant spacing between neighboring terminal connectors b1 of the apposition type power cable b induces inflexibility in performance. Consequently, such a kind of power cable b and its terminal connector b1 cannot effectively solve the aforementioned problems also.

SUMMARY OF THE PRESENT INVENTION

The primary objective of the present invention is to provide a separable power transmission cable, which comprises: a connector, which has a first connect part, a second connect part, a third connect part utilized to insertedly joint to an electronic device; and an electrically-conductive line, which is electrically coupled to the second connect part and has an electric plug, wherein the first connect part is electrically coupled to a power supply, or separably and electrically coupled to the electric plug of the precedent electrically-conductive line to enable the user to determine the length and quantity of the power transmission cable to be connected according to the quantity of the electronic devices so that the problems resulting from the inseparable redundant cable in the conventional power transmission cable can be avoided.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The detailed technical contents of the present invention will be described below in cooperation with the drawings.

Figure 1:
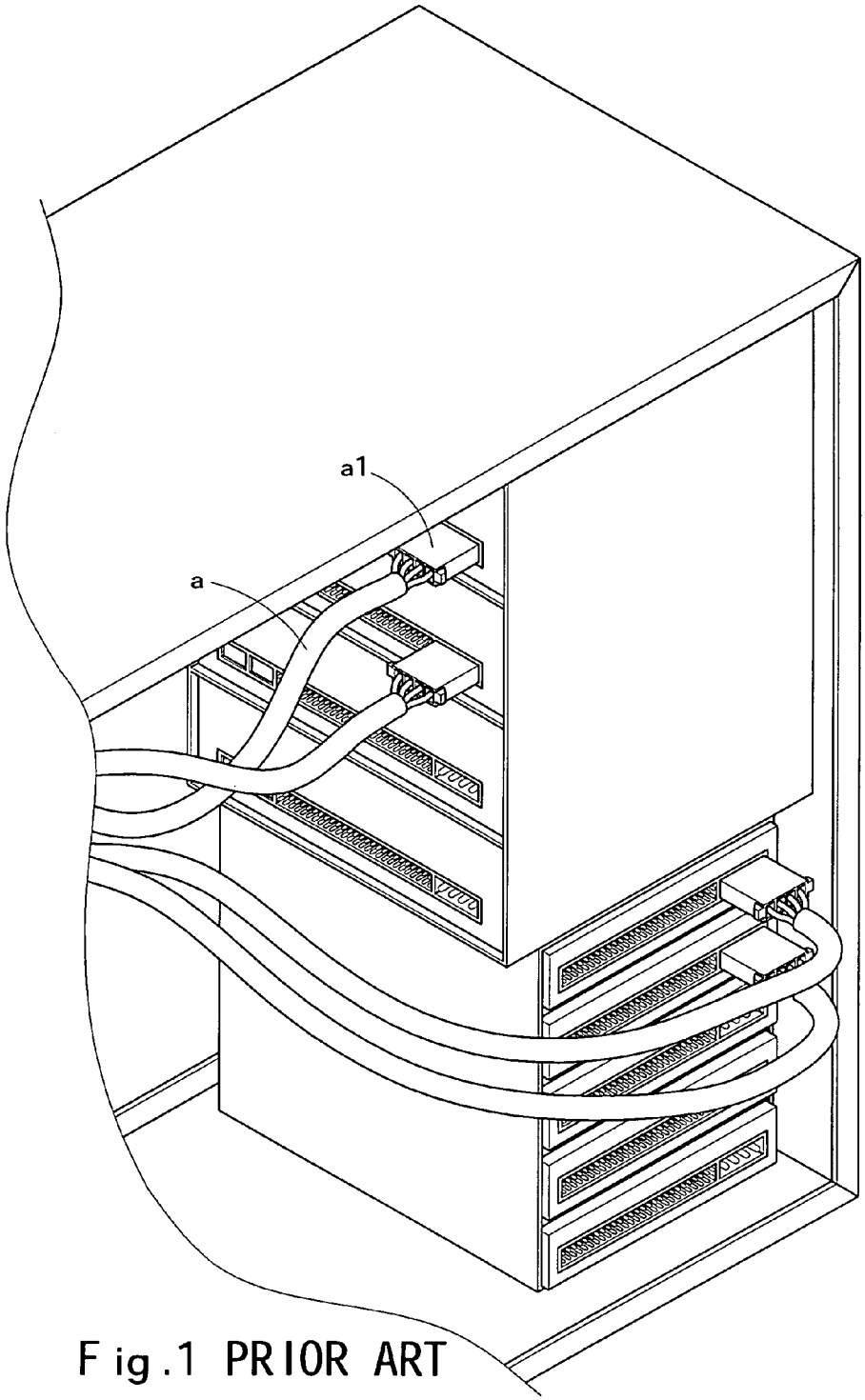
Fig.1 PRIOR ART
FIG. 1 is the schematic diagram showing the connection of the conventional power cable.
Figure 2:
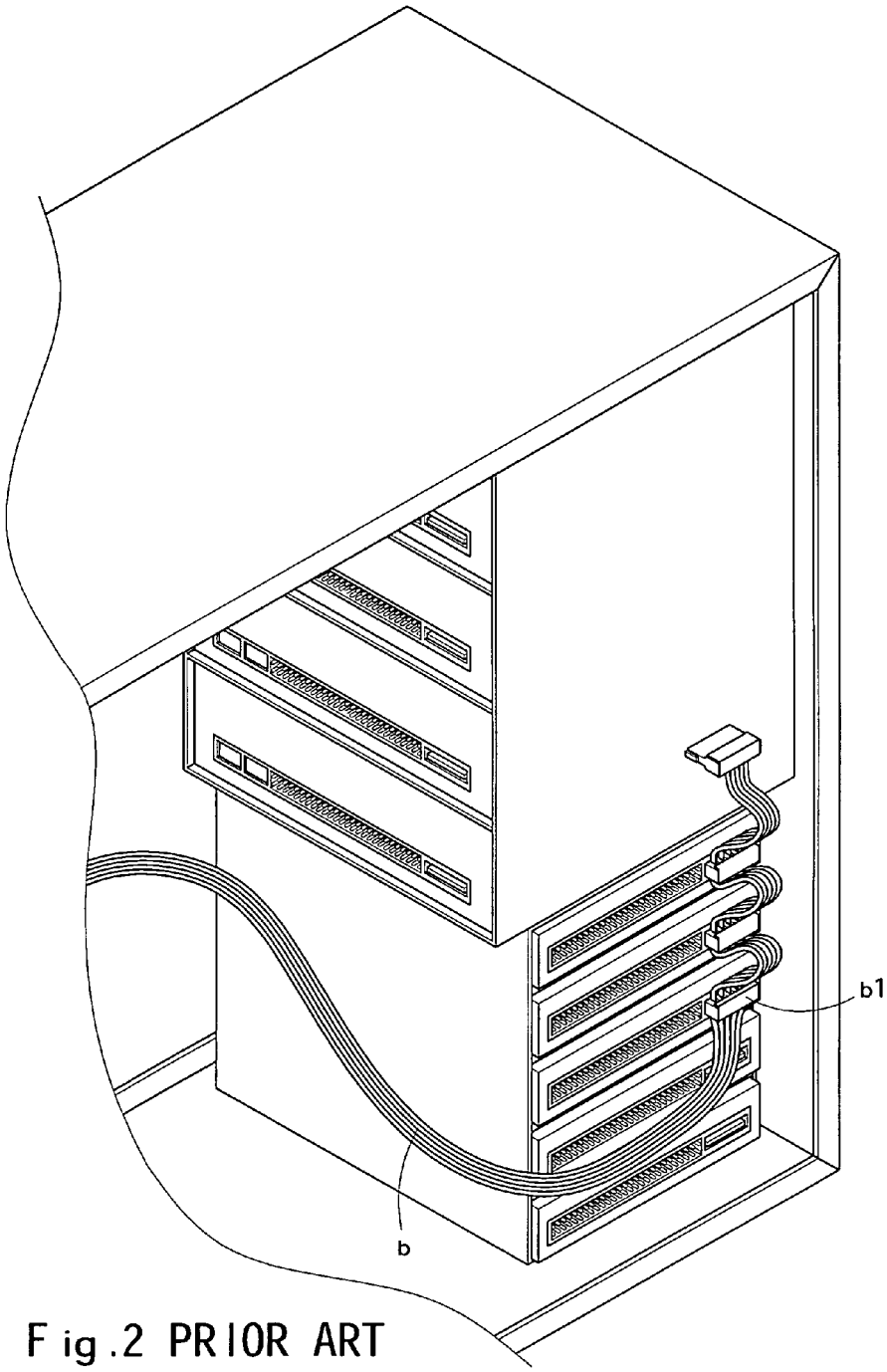
Fig.2 PRIOR ART
FIG. 2 is the schematic diagram showing the piercing type of conventional power cable.
Figure 3:
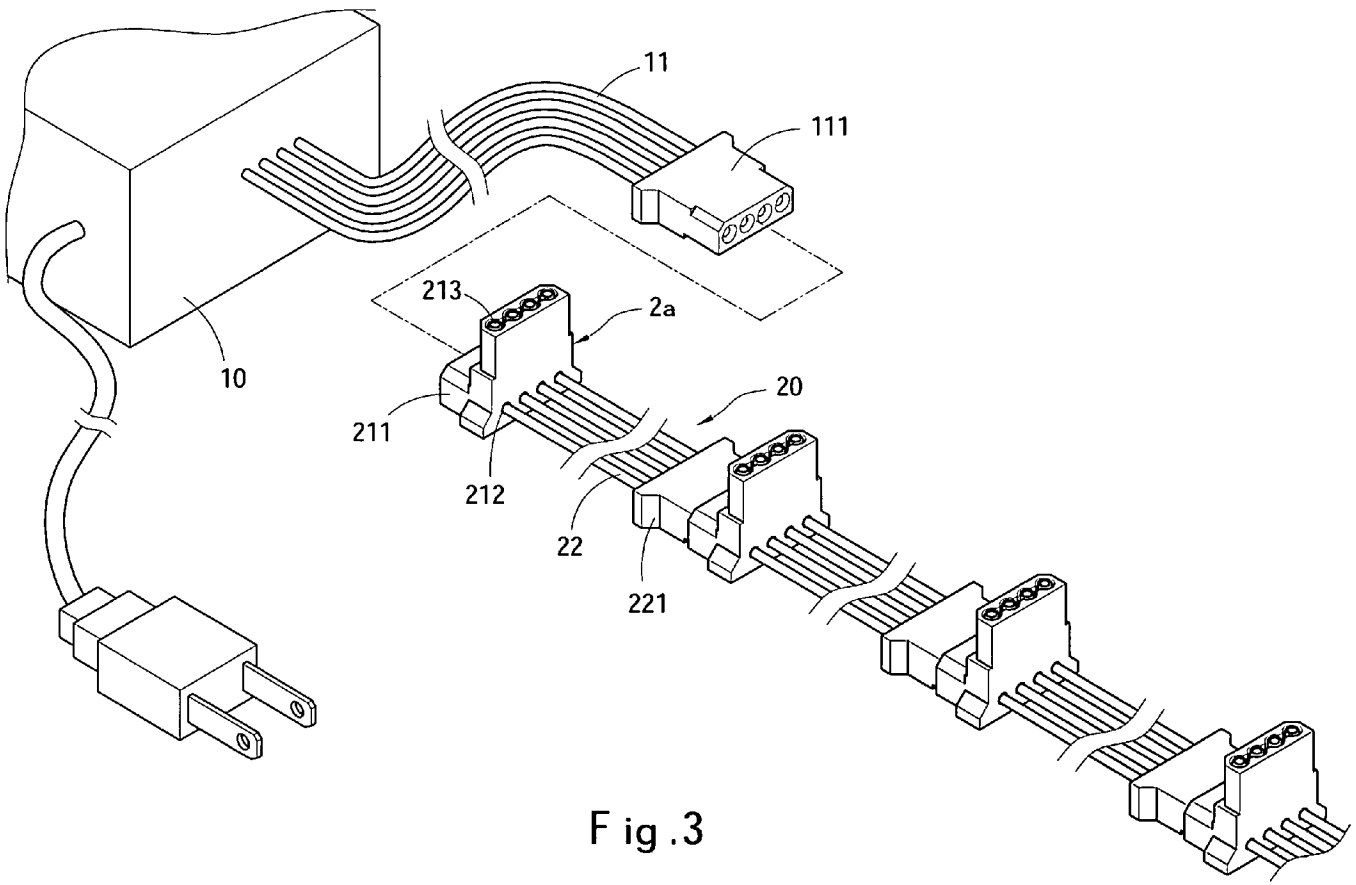
FIG. 3 is the schematic diagram showing the connection of the power transmission cable according to a first embodiment of the present invention.
Figure 4:
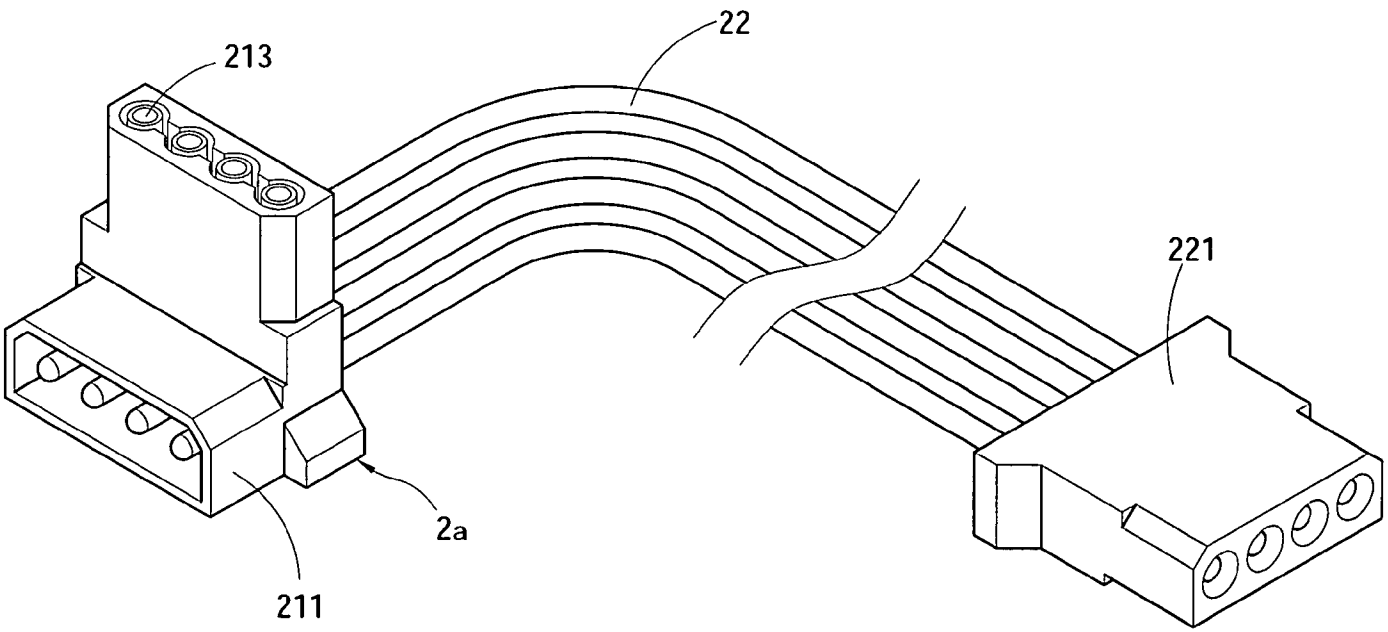
FIG. 4 is the schematic diagram showing a unitary power transmission cable according to a first embodiment of the present invention.

Referring to FIG. 3 and FIG. 4, the schematic diagrams of the power transmission cable 20 according to the first embodiment of the present invention, at least one set of power transmission cable 20 is electrically coupled to a power supply 10 and an electronic device powered by the power supply 10. To standardize the drawings of the present invention, the power transmission cable 20 of 4PIN AT/ATX specification is used for illustration. The power transmission cable 20 comprises: a connector 2*a*, which further comprises: a first connect part 211, a second connect part 212, and a third connect part 213 vertical to the first connect part 211 and utilized to insertedly joint to the electronic device; and an electrically-conductive line 22, which is electrically coupled to the second connect part 212 and has an electric plug 221, wherein the first connect part 211 is electrically coupled to the power supply 10, or separably and electrically coupled to the electric plug 221 of the precedent electrically-conductive line 22.

The connection methods of the present invention include:

A. In the embodiment shown in FIG. 3 and FIG. 4, the first connect part 211, which is electrically coupled to the power supply 10, is separably and electrically coupled to a power-output line 11 of the power supply 10, and the end of the power-output line 11 has an electric plug 111. The electrically-conductive line 22 is normally and electrically coupled to the second connect part 212 via a fixed-connection technology, such as weld joint, press joint, etc. The second connect part 212 is disposed horizontally with respect to the first connect part 211. It is obvious for this embodiment that the user can determine the overall length of the power transmission cable 20 in assembly or in separation according to the positions where the power-output line 11 of the power supply 10 or each segment of electrically-conductive line 22 of the power transmission cable 20 connects with the connector 2*a*. Thus, the user can determine the length and quantity of the power transmission cable 20 to be connected according to the quantity of the electronic devices so that the problems resulting from the inseparable redundant cable in the conventional transmission power cable can be avoided. Further, as the third connect part 213 is disposed vertically with respect to the first connect part 211 to insertedly joint to the electronic device, and as the assembled overall power transmission cable 20 is in apposition, cable management will be easily performed.

Figure 5:
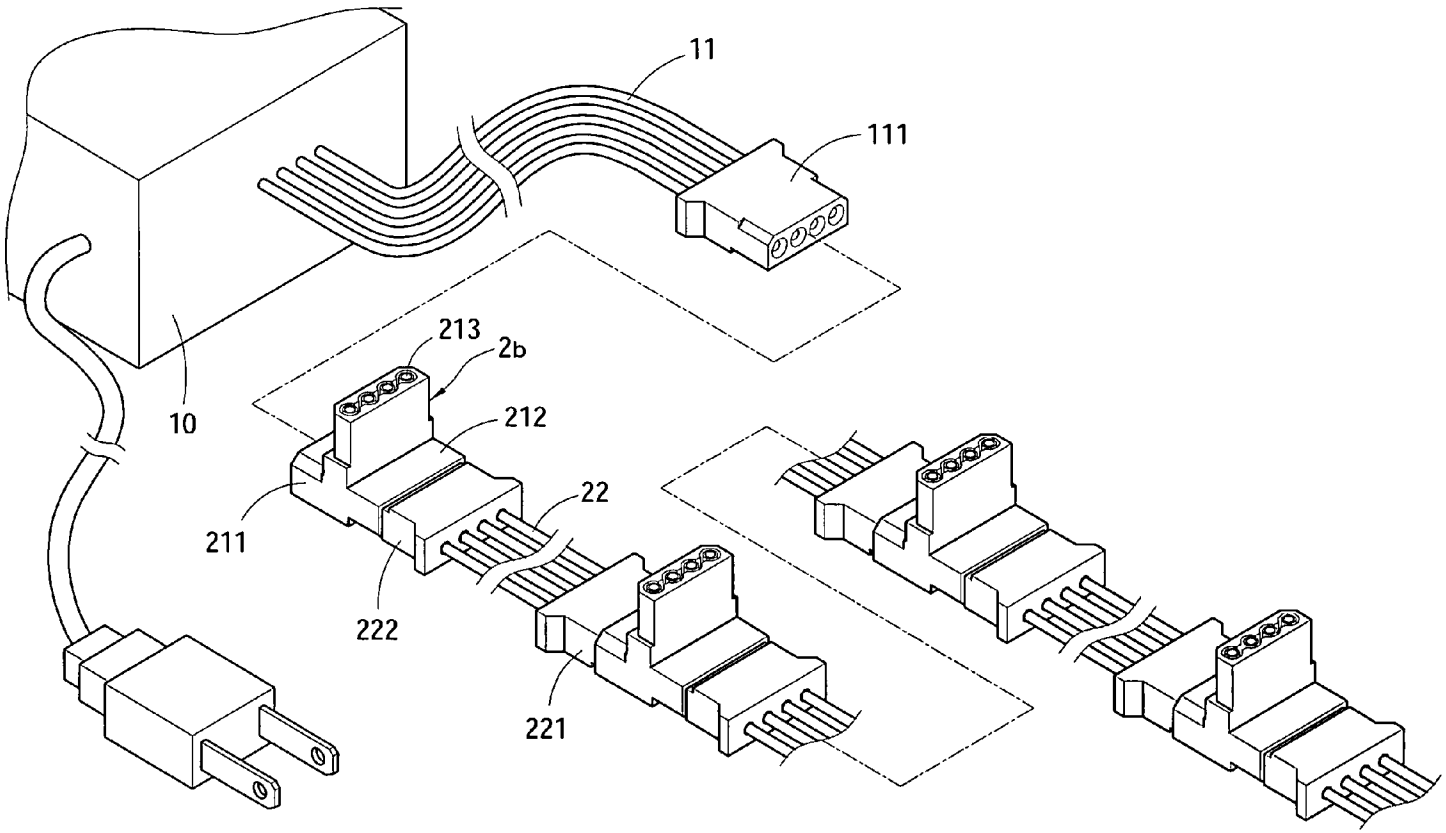
FIG. 5 is the schematic diagram showing the connection of the power transmission cable according to a second embodiment of the present invention.
Figure 6:
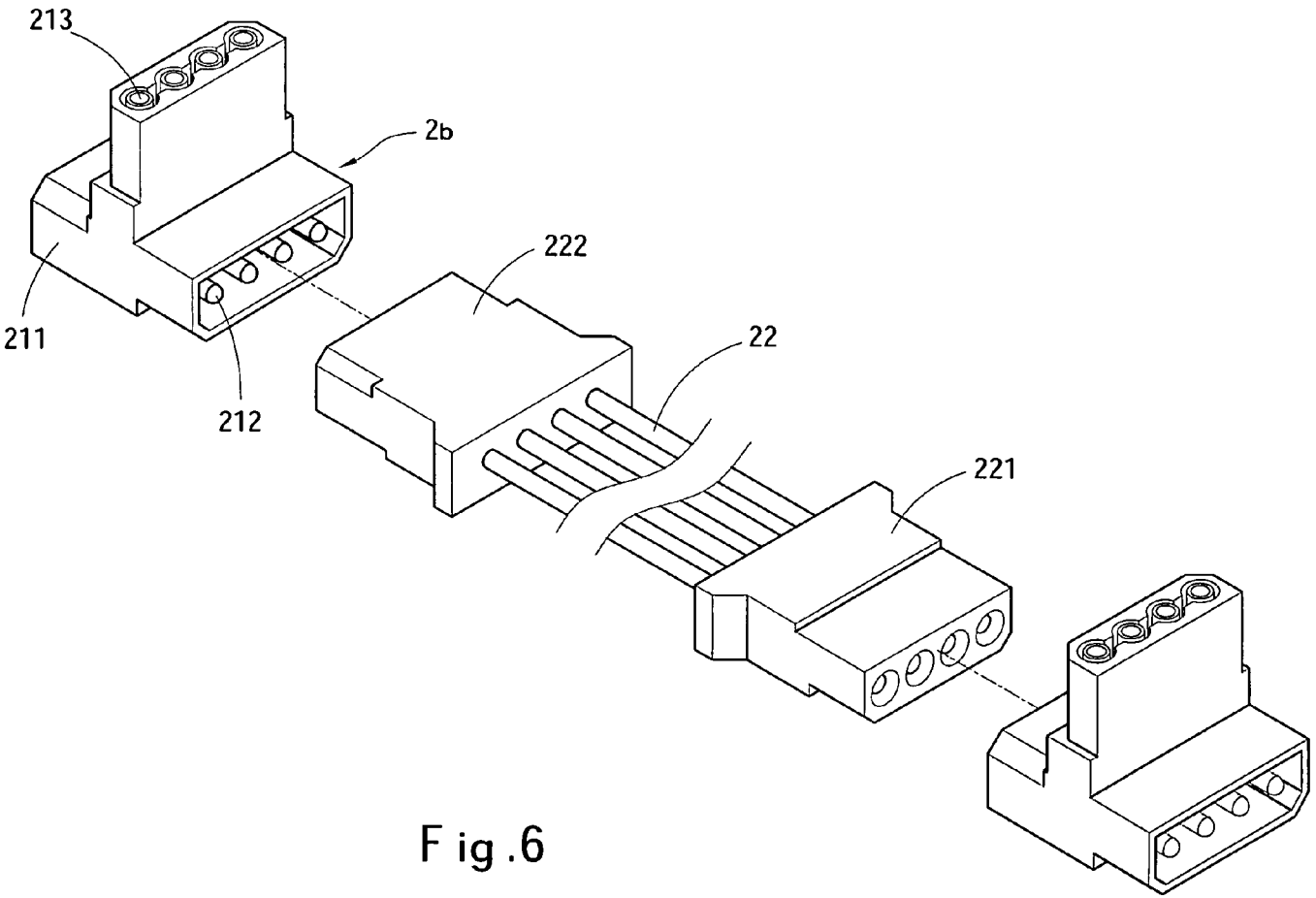
FIG. 6 is the schematic diagram showing the connection of the neighboring power transmission cables according to a second embodiment of the present invention.

B. In comparison with the precedent embodiment, in the embodiment shown in FIG. 5 and FIG. 6, the end of the electrically-conductive line 22 further has an electric plug 222, which can be separably and electrically coupled to the second connect part 212 of the connector 2*b*, i.e. the second connect part 212 functions as an insertion-joint port, which enable the present invention to be more flexible in application.

Figure 7:
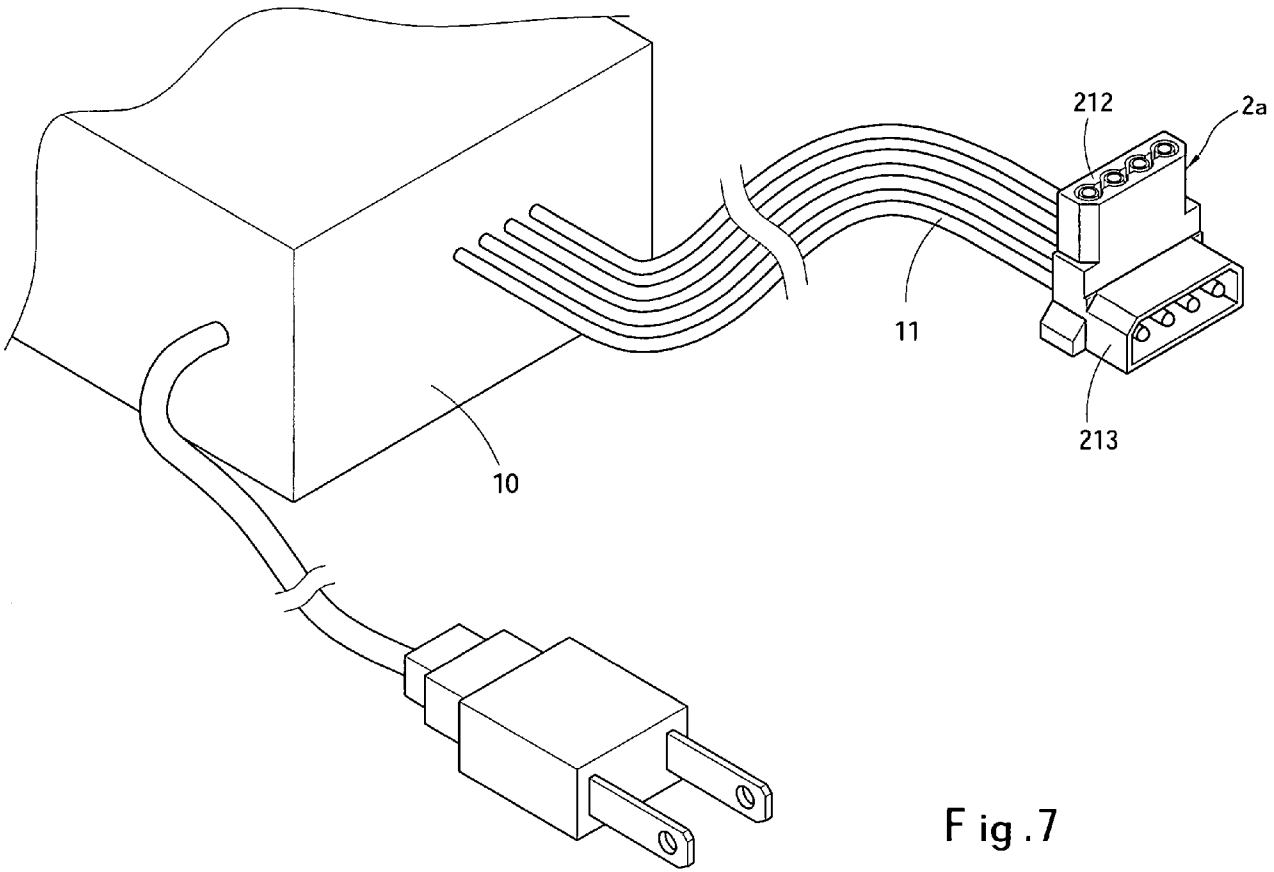
FIG. 7 is the schematic diagram of the power transmission cable according to a third embodiment of the present invention.

C. In the embodiment shown in FIG. 7, the first connect part 211, which is electrically coupled to the power supply 10, is normally and electrically coupled to the power-output line 11 via a fixed-connection technology, such as weld joint, press joint, etc. The rest is the same as mentioned above.

Figure 8:
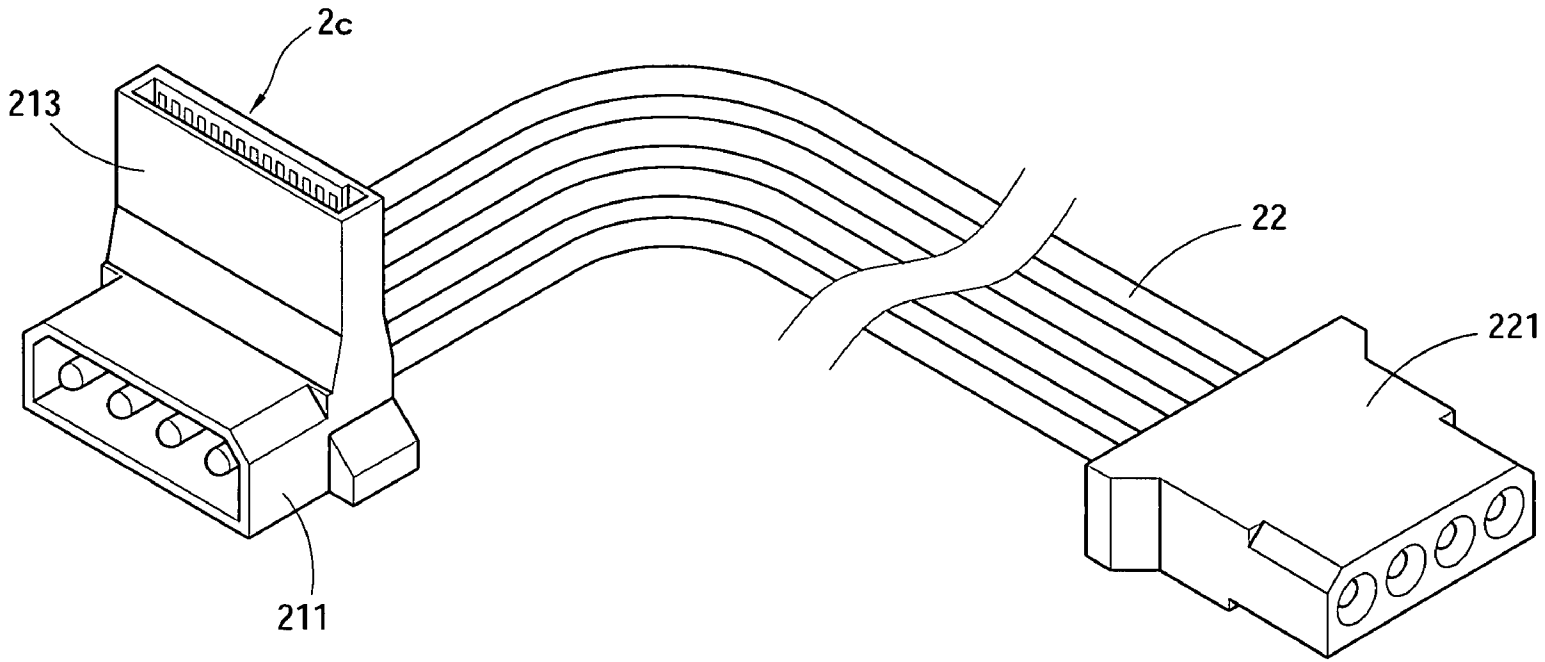
FIG. 8 is the schematic diagram of the power transmission cable according to a fourth embodiment of the present invention.

D. The embodiment shown in FIG. 8 demonstrates: in addition to the power transmission cable 20 of 4PIN AT/ATX specification, it is obvious for the present invention to apply to the power transmission cable 20 of other specifications, which is exemplified by the connector 2*c* having the third connect part 213 of SATA specification connector in FIG. 8.

Figure 9:
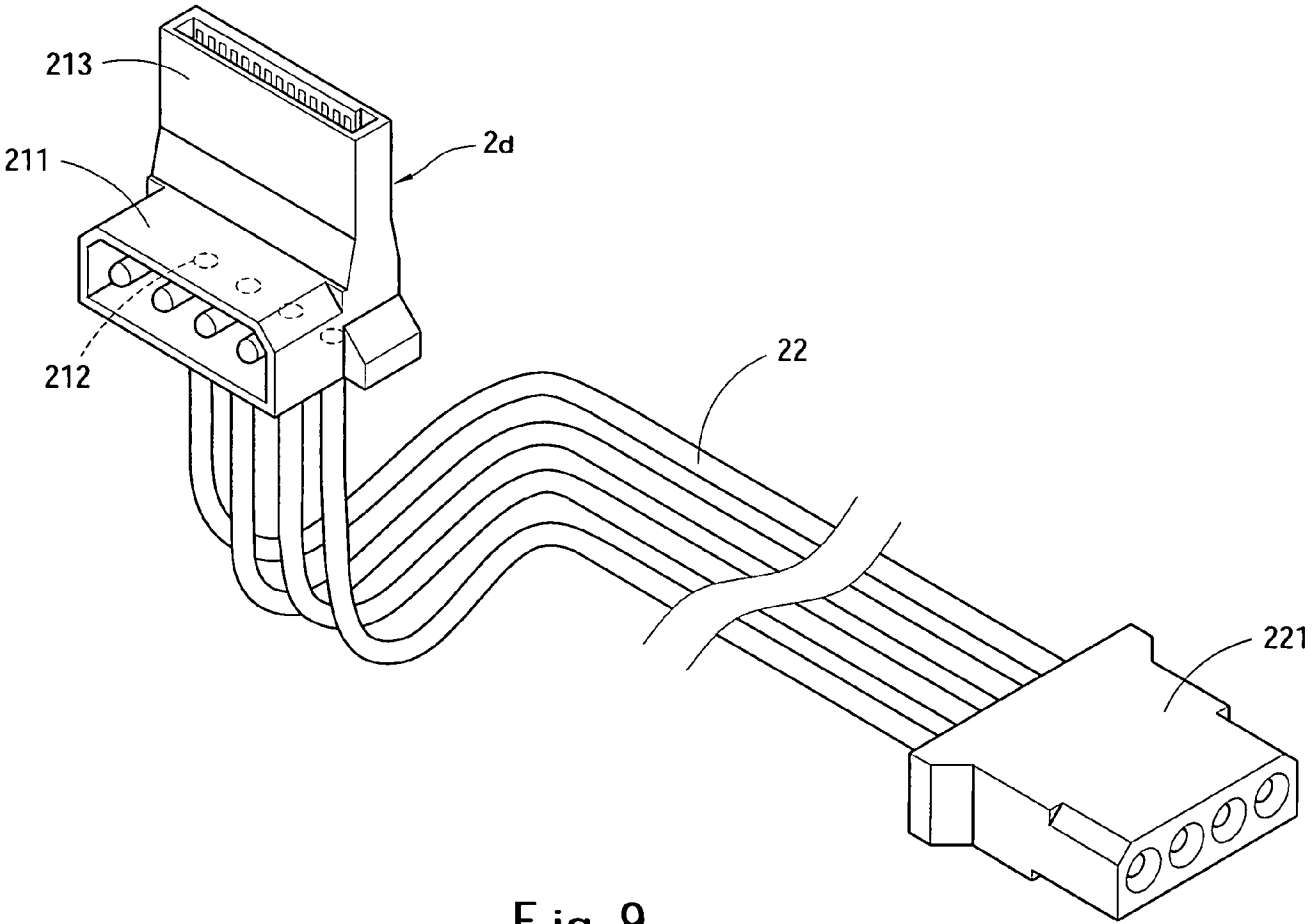
FIG. 9 is the schematic diagram of the power transmission cable according to a fifth embodiment of the present invention.

E. The embodiment shown in FIG. 9 illustrates: the second connect part 212 of the connector 2*d* can also be disposed vertically with respect to the first connect part 211, which can also achieve the efficacy of the separable power transmission cable 20 of the present invention.

Figure 10:
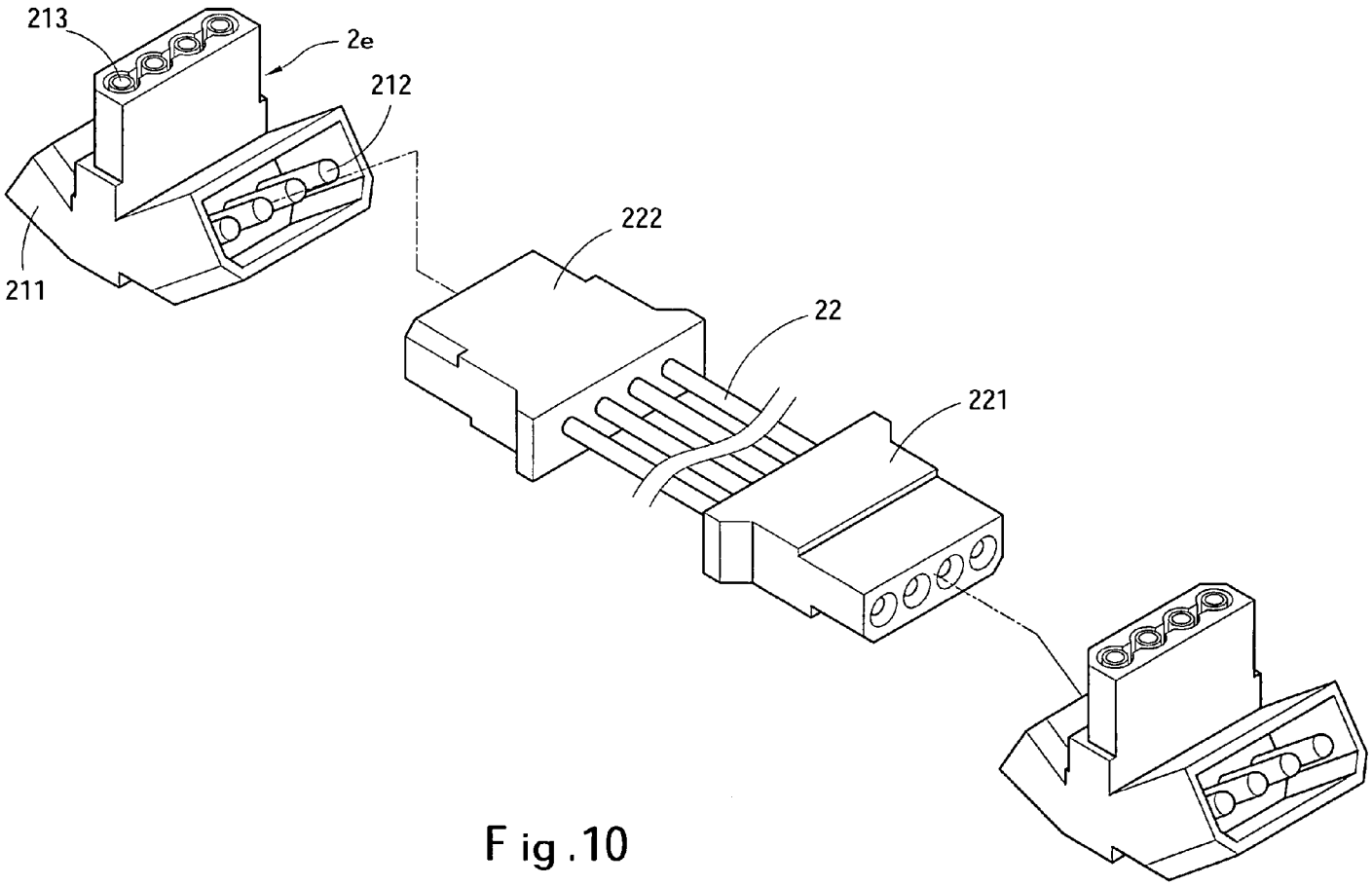
FIG. 10 is the schematic diagram of the power transmission cable according to a sixth embodiment of the present invention.

F. The embodiment shown in FIG. 10 illustrates: the first connect part 211 or the second connect part 212 of the connector 2*e* can also be disposed obliquely with respect to the third connect part 213 so that the present invention can meet different insertion modes of various electronic devices.

Those described above are only the preferred embodiments of the present invention but not intended to limit the scope of the present invention. Any equivalent modification and variation according to the spirit of the present invention are to be included within the scope of the present invention.

What is claimed is:

1. A power transmission cable, wherein at least one power transmission cable electrically interconnects a power supply and electronic devices are powered by said power supply, wherein said power transmission cable comprises a connector, which further comprises:

a first connect part, a second connect part, and a third connect part utilized to insertedly join to said electronic device; and an electrically-conductive line, which is electrically coupled to said second connect part and has an electric plug, wherein said first connect part is electrically coupled to said power supply and separably and electrically coupled to a power-outputting line of said power supply, the end of said power-outputting line having an electric plug, and wherein said first connect part is separably and electrically coupled to said electric plug of said electrically-conductive line.

2. The power transmission cable according to claim 1, wherein said first connect part, which is electrically coupled to said power supply, is normally and electrically coupled to a power-outputting line of said power supply.

3. The power transmission cable according to claim 2, wherein said electrically-conductive line is normally and electrically coupled to said second connect part.

4. The power transmission cable according to claim 3, wherein said second connect part is disposed horizontally with respect to said first connect part.

5. The power transmission cable according to claim 3, wherein said second connect part is disposed vertically with respect to said first connect part.

6. The power transmission cable according to claim 2, wherein the end of said electrically-conductive line has another one electric plug, which can be separably and electrically coupled to said second connect part.

7. The power transmission cable according to claim 6, wherein said second connect part is disposed horizontally with respect to said first connect part.

8. The power transmission cable according to claim 1, wherein said electrically-conductive line is normally and electrically coupled to said second connect part.

9. The power transmission cable according to claim 8, wherein said second connect part is disposed horizontally with respect to said first connect part.

10. The power transmission cable according to claim 8, wherein said second connect part is disposed vertically with respect to said first connect part.

11. The power transmission cable according to claim 1, wherein the end of said electrically-conductive line has another one electric plug, which can be separably and electrically coupled to said second connect part.

12. The power transmission cable according to claim 8, wherein said second connect part is disposed horizontally with respect to said first connect part.

13. The power transmission cable according to claim 1, wherein the end of said electrically-conductive line has another one electric plug, which can be separably and electrically coupled to said second connect part.

14. The power transmission cable according to claim 13, wherein said second connect part is disposed horizontally with respect to said first connect part.

15. The power transmission cable according to claim 1, wherein said electrically-conductive line is normally and electrically coupled to said second connect part.

16. The power transmission cable according to claim 15, wherein said second connect part is disposed horizontally with respect to said first connect part.

17. The power transmission cable according to claim 15, wherein said second connect part is disposed vertically with respect to said first connect part.

* * * * *